US005307824A

United States Patent [19]

Bannett

[11] Patent Number: 5,307,824

[45] Date of Patent: May 3, 1994

[54] NAIL PIERCER

[76] Inventor: Ronald Bannett, 4530 N. Hiatus Rd., Unit #109, Sunrise, Fla. 33351

[21] Appl. No.: 60,023

[22] Filed: May 10, 1993

[51] Int. Cl.[5] ..... A45D 29/18

[52] U.S. Cl. ..... 132/75.5; 132/75.4; 30/28

[58] Field of Search ..... 132/75.4, 75.5; 30/28

[56] References Cited

U.S. PATENT DOCUMENTS

| | | | |
|---|---|---|---|
| 810,402 | 1/1906 | Friese | 132/75.5 |
| 1,836,557 | 12/1931 | Seymoure | 132/75.5 |
| 2,890,706 | 6/1959 | Guardino | 132/75.5 |
| 3,154,850 | 11/1964 | Okuno | 132/75.4 |
| 3,315,354 | 4/1967 | Oates, Jr. | 30/28 |
| 4,637,137 | 1/1987 | Husain | 30/28 |
| 4,964,213 | 10/1990 | Suggs | 30/28 |
| 4,982,747 | 1/1991 | Shah | 132/75.4 |

FOREIGN PATENT DOCUMENTS

| | | | |
|---|---|---|---|
| 2168920 | 7/1986 | United Kingdom | 30/28 |

*Primary Examiner*—Gene Mancene
*Assistant Examiner*—Frank A. LaViola
*Attorney, Agent, or Firm*—Malin, Haley, DiMaggio, & Crosby

[57] ABSTRACT

A fingernail piercer for piercing a hole in long natural or artificial nails in a single stroke, comprising an upper tine, a lower tine, an actuator handle, and a sliding joint guide member, wherein the upper and lower tines are connected at one end, have apertures at the opposite end to accommodate the sliding joint guide member, and a closeable nail receiving chamber. The actuator handle is attached to the upper tine to induce a cantilevered load when actuated, vertically piercing an entrapped fingernail.

7 Claims, 1 Drawing Sheet

NAIL PIERCER

BACKGROUND OF THE INVENTION

The present invention relates generally to a finger nail piercer, more particularly to a piercer for piercing a hole in long natural or artificial nails.

SUMMARY OF THE INVENTION

The instant invention provides a single-stroke nail piercer useful for piercing long natural or artificial nails comprising efficient design and simplicity of manufacture. The nail piercer is generally comprised of an upper tine, a lower tine, an actuator handle, a sliding joint guide member and an elastic stressed machine element. The actuator handle is a machined or cast elongated planar member having a top and bottom surface, and a proximal and distal end. Near the proximal end there is disposed a slight twist in profile to facilitate grasping, and near the distal end, an aperture for attachment to the other components in a sliding joint. A small male protrusion extends normal to the bottom surface of the handle adjacent to the aperture. The upper and lower tines are machined or cast elongated planar members having proximal and distal ends and top and bottom surfaces. Both have an aperture near their respective distal ends for accommodating the sliding joint guide member. The upper and lower tines are of angled profile such that when they are fastened at their respective proximal ends, and attached to the actuator handle via the sliding joint guide member, the resulting assembly is a bifurcated nail piercer which forms a nail receiving chamber at one end. A pointed piercing member is disposed normal, and rigidly attached to the bottom surface of the upper tine. The lower tine has a stepped member rigidly attached to the top surface thereof, which functions as a means for positioning the nail to be pierced inside the nail receiving chamber, and which has an aperture defined normal therethrough, whereby said piercing member may pass through the step member in a prescribed path through a portion of the nail to be pierced. An accommodation hole collineally disposed relative to the step aperture is also provided so that the piercing member may be received within the lower tine. Additionally, an elastic stressed machine element is wrapped around the sliding joint guide member between the upper and lower tines to help the upper tine recover its position when the actuator handled is released.

Piercing is effectuated by sliding a nail between the stepped member and lower tine top surface, and thereafter exerting force on the proximal end of the actuator hand*p2028Xwhile simultaneously gripping the entire piercer assembly. The handle induces a cantilevered load in the upper tine at the sliding joint which restricts the motion of the upper tine to vertical translation, thereby biasing the pointed piercing member from a first position through the nail and into the accommodation hole contained in the lower tine at a second position. Upon unloading the actuator handle, the residual bending strain energy in the upper tine along with the elastic stored energy element forces the piercer to return to its open position.

It is an object of the present invention to provide a piercer capable of safely piercing a fingernail in a single stroke.

It is a further object of the present invention to provide a nail piercer of simple, efficient, and economical design which is readily amenable to high rate and low cost manufacture.

It is still a further object of the invention to provide a nail piercer that is easy to operate, and compact and lightweight for easy storage when not in use.

The invention will be best understood when the aforementioned is addressed in conjunction with the hereinafter detailed component description and drawings.

DETAILED DESCRIPTION OF THE PREFERRED EMBODIMENT

Figure 1:
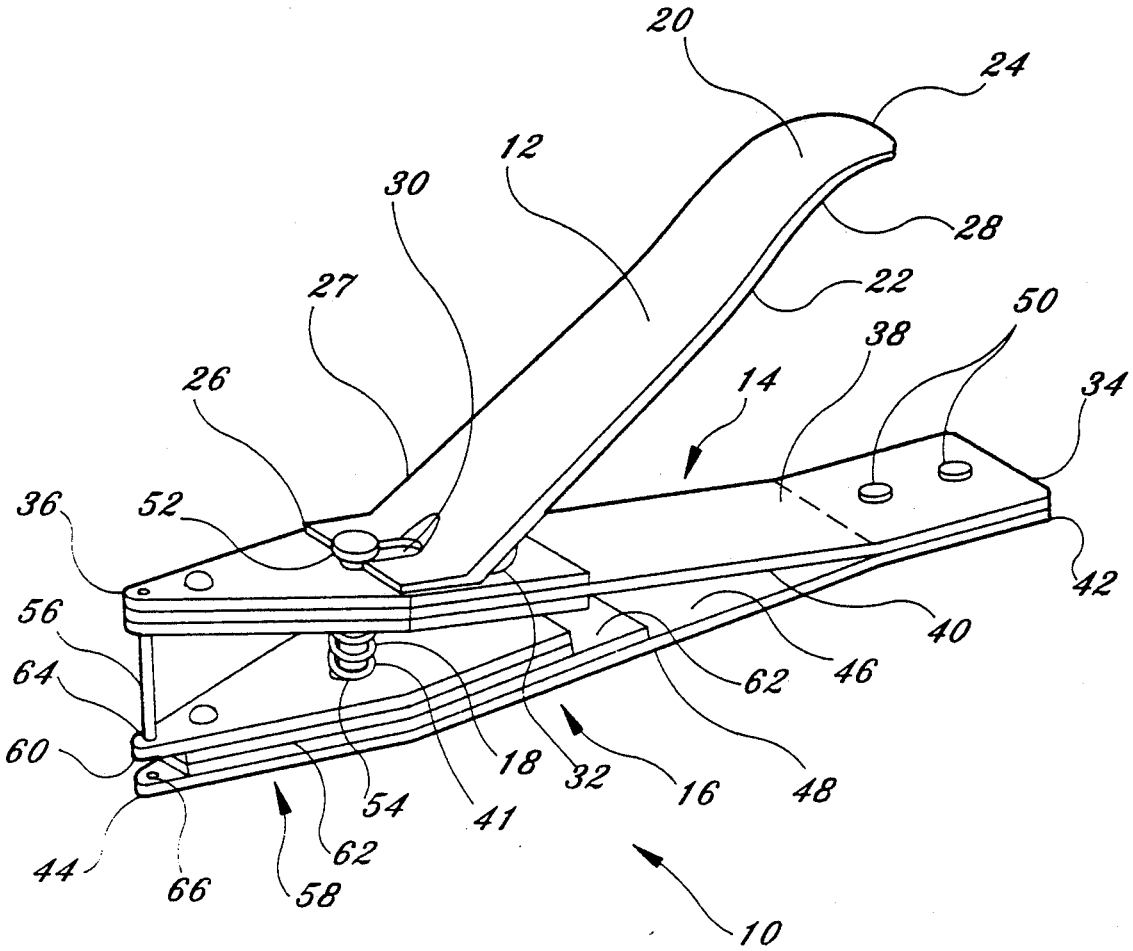
FIG. 1 is an isometric view of the piercer assembly.

With reference to the views of the drawing, FIG. 1 depicts a bifurcated nail piercer 10 generally comprising an upper tine 14; a lower tine 16; an actuator handle 12; and guide 18. Nail piercer 10 will operate essentially in two positions. In the first position, no pressure will be applied to handle 12.

The actuator handle 12 is a machined or cast planar elongated member having a top surface 20, a bottom surface 22, a proximal end 24 and distal end 26. A curved portion 28 is provided near proximal end 24 to facilitate grasping. The distal end 26 has a flanged portion 27 disposed at an obtuse angle to the body portion and an aperture 30 through which guide 18 is attached to handle 12 and upper tine 14. A male protrusion 32 is disposed adjacent to the aperture 30 and normal to bottom surface 22 for applying a bearing cantilevered load on the upper tine 14 upon manual actuation of handle 12.

The upper tine 14 is a machined or cast planar elongated member having a proximal end 34, a distal end 36, a top surface 38, and a bottom surface 40. The lower tine 16 is a machined or cast planar elongated member having a proximal end 42, a distal end 44, a top surface 46, and a bottom surface 48. Each tine has an angular profile, so that when the piercer is fully assembled, the resulting structure is a bifurcation oriented in a first position. The upper and lower tines, 14 and 16 respectively, are fastened together at their respective proximal ends 34 and 42 via fastening means such as a pair of rivets 50. Both tines 14 and 16 are additionally tied together in a sliding joint by inserting guide member 18 through apertures 52 and 54 defined in both tines respectively. The guide member 18 also has an elastic stressed element 41 wrapped around it so that the upper tine 14 recovers the first position when the actuator handle is not engaged.

Figure 2:
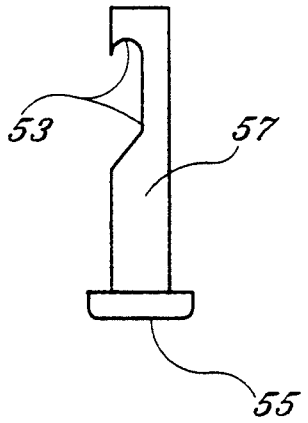
FIG. 2 is an elevation view of the guide member.

FIG. 2 depicts the sliding joint guide member 18, which is an elongated cylindrical structure having a hook 53 and a head portion 55 separated by a body portion 57, which connects the actuator handle 12, upper tine 14, and lower tine 16 in a sliding joint.

Piercer 10 is assembled by riveting upper and lower tines 14 and 16 at their proximal ends 34 and 42 respectively. Elastic element 41 is slip fit on guide member body portion 57, and the guide member 18 is subsequently inserted through apertures 54 and 52 in lower and upper tines 16 and 14 respectively exposing hook portion 53. Handle 12 is then pivotally attached to guide member 18 at hook portion 53 with male protrusion 32 bearing on upper tine top surface 38 when piercer 10 is in use, and which may be pivoted to reverse orientation when desired for storage.

A pointed piercing member 56 is rigidly attached to, or unitarily formed with, bottom surface 40 of upper tine 14 near distal end 34, by welding or similar means, and extends perpendicularly outward therefrom. A stepped positioning member 58 defined by an upper step 60 and lower steps 62 is rigidly attached to lower tine 16 by welding, riveting or similar means to attach steps 62 to top surface 46 of lower tine 16 near distal end 44. Upper step 60 defines a hole 64 therethrough collineally disposed relative to piercing member 56, so that a portion of a nail to be pierced may be positioned inside the nail receiving chamber between upper step 60 and top surface 46 of lower tine 16 thereby allowing piercing member 56 to follow a prescribed vertical path through the nail, a thru-hole 66 is disposed collineal with piercing member 56 and hole 64 in upper step 60 to accommodate piercing member 56 upon actuation of piercer 10.

Releasing pressure on the handle 12 causes the residual bending strain energy in the piercer upper tine 14 and the stressed stored-energy in the elastic element 41 to restore the piercer 10 to its open or first position.

The invention described herein has been shown in what is considered the most practical embodiment. It is anticipated that departures may be made therefrom within the scope of the invention and that obvious modifications will be implemented by a person skilled in the art.

What I claim is:

1. An apparatus for piercing a nail comprising:

an upper tine having a proximal and distal end, and an elongated planar and angled body portion disposed therebetween, defining a top and bottom surface, said upper tine further having an aperture defined normal therethrough adjacent said distal end;

a lower tine having a proximal and distal end, and an elongated planar and angled body portion disposed therebetween defining a top and bottom surface, said lower tine attached to said upper tine at said upper and lower tine proximal ends, said upper and lower tine forming a nail receiving chamber at said upper and lower tine distal ends, said lower tine having an aperture defined normal therethrough adjacent said lower tine distal end;

a piercing member rigidly secured to said bottom surface of said upper tine and extending perpendicularly outward therefrom;

means for positioning said nail within said nail receiving chamber, said means for positioning rigidly attached to said lower tine top surface; and means for reciprocating said upper and lower tines between a first and second position attached to said upper and lower tines respectively.

2. The apparatus of claim 1, wherein said means for positioning comprises a stepped member defined by an upper and lower step, said lower step being rigidly attached to said top surface of said lower tine, and said upper step having an aperture normal therethrough, whereby said piercing member may pass through said upper step.

3. The apparatus of claim 2 wherein said piercing member is pointed.

4. The apparatus of claim 1, wherein said means for reciprocating comprises:

a handle having a proximal and distal end, said handle having a top and bottom surface, said handle having an aperture at said handle distal end, said handle having a protrusion at said distal end extending outward from said bottom surface of said handle, said handle having an angled flange portion adjacent to, and flush against, said upper tine; and a guide member having a hooked top end, said guide member extending through said upper and lower tine apertures and said handle apertures respectively, said hooked top end pivotally connecting said handle flange portion to said upper tine; and an elastic stressed element concentrically and slidably disposed on said guide member between said upper and lower tines.

5. The apparatus of claim 4, wherein said handle further comprises a slight twist in profile intermediate said proximal and said distal ends of said handle.

6. The apparatus of claim 1, wherein said means for positioning comprises a stepped member rigidly attached to said top surface of said lower tine, and said step member having an aperture normal therethrough, whereby said piercing member may pass through said step member.

7. An apparatus for piercing a nail, comprising:

an upper tine having a proximal and distal end, and an elongated planar and angled body portion disposed therebetween, defining a top and bottom surface, said upper tine further having an aperture defined normal therethrough adjacent said distal end;

a lower tine having a proximal and distal end, and an elongated planar and angled body portion disposed therebetween, defining a top and bottom surface, said lower tine further having an aperture defined normal therethrough adjacent said lower tine distal end; said lower tine rigidly secured to said upper tine at said respective proximal ends, whereby said upper and lower tines form a nail receiving chamber at said respective distal ends;

means for piercing said nail disposed at said distal end of said upper and lower tines, said means for piercing comprising:

a pointed piercing member rigidly secured to said bottom surface of said upper tine, and extending perpendicularly outward therefrom; and means for positioning said nail within said nail receiving chamber, said means for positioning rigidly attached to said lower tine top surface, said means for positioning comprising a stepped member defined by an upper and lower step, said lower step being rigidly attached to said top surface of said lower tine, and said upper step having an aperture normal therethrough, whereby said piercing member may pass through said upper step; and means for reciprocating said upper and lower tines between a first and second position, said means for reciprocating comprising: a handle having a proximal and distal end, said handle having a top and bottom surface, said handle having an aperture at said handle distal end, said handle having a protrusion at said distal end extending outward from said bottom surface of said handle, said handle having an angled flange portion adjacent to, and flush against, said upper tine; a guide member having a hooked top end, said guide member extending through said upper and lower tine apertures and said handle apertures, said hooked top end pivotally connecting said handle flange portion to said upper tine; and an elastic member slidably and concentrically disposed on said guide member between said upper and lower tines.

* * * * *